US005206124A

United States Patent [19]

Shimazaki et al.

[11] Patent Number: 5,206,124

[45] Date of Patent: Apr. 27, 1993

[54] LIGHT-SENSITIVE SILVER HALIDE COLOR PHOTOGRAPHIC MATERIAL

[75] Inventors: Hiroshi Shimazaki, Hachioji; Yasushi Irie, Hino; Katuya Yabuuchi, Musashimurayama, all of Japan

[73] Assignee: Konica Corporation, Tokyo, Japan

[21] Appl. No.: 832,934

[22] Filed: Feb. 11, 1992

[30] Foreign Application Priority Data

Feb. 14, 1991 [JP] Japan ..... 3-42530

[51] Int. Cl.[5] ..... G03C 1/46

[52] U.S. Cl. ..... 430/505; 430/502; 430/503; 430/508; 430/957

[58] Field of Search ..... 430/502, 508, 505, 957, 430/503

[56] References Cited

U.S. PATENT DOCUMENTS

| | | | |
|---|---|---|---|
| 4,686,175 | 8/1987 | Ogawa et al. | 430/505 |
| 4,806,459 | 2/1989 | Makino et al. | 430/505 |
| 5,077,182 | 12/1991 | Sasaki et al. | 430/505 |
| 5,081,008 | 1/1992 | Deguchi | 430/507 |

FOREIGN PATENT DOCUMENTS

| | | | |
|---|---|---|---|
| 0434043 | 6/1991 | European Pat. Off. . | |
| 1123832 | 6/1986 | Japan | 430/502 |

*Primary Examiner*—Charles L. Bowers, Jr.
*Assistant Examiner*—Gealdine Letscher
*Attorney, Agent, or Firm*—Finnegan, Henderson, Farabow, Garrett & Dunner

[57] ABSTRACT

A silver halide color photographic light-sensitive material is disclosed. The light-sensitive material is excellent in reproducibility of blue-green or green colored photographic subject. The light-sensitive material has a blue-sensitive layer, green-sensitive layer and a red-sensitive layer. The blue-sensitive layer has the maximum spectral sensitivity at a wavelength within the range of 415 to 470 nm and the spectral sensitivity at 480 nm of the blue-sensitive layer is not more than 35% of the maximum sensitivity. The green-sensitive layer has the maximum spectral sensitivity at a wavelength within the range of 530 nm to 560 nm and the spectral sensitivity at 500 nm of the green-sensitive layer is not less than 25% of the maximum sensitivity.

3 Claims, No Drawings

LIGHT-SENSITIVE SILVER HALIDE COLOR PHOTOGRAPHIC MATERIAL

FIELD OF THE INVENTION

The present invention relates to a light-sensitive color photographic material, and more particularly to a light-sensitive color photographic material having a superior color reproducibility.

BACKGROUND OF THE INVENTION

In recent years, image qualities of light-sensitive multi-layer color photographic materials have been remarkably made higher.

That is, in recently available color photographic materials, all the graininess, sharpness and color reproducibility, the three important factors of image quality, are on a reasonably high level. For example, with regard to color photographs of general use, color prints or slides handed to users are considered to be substantially satisfactory in usual instances.

However, among the above three factors, in particular, the color reproducibility has been improved in respect of color purity indeed, but is still not so much improved in respect of the colors having been considered it difficult to reproduce. Namely, reproduction of hues is still unsatisfactory in many ways. For example, purple and colors similar to purple as exemplified by bluish purple, or colors similar to green as exemplified by blue-green and yellow-green tends to be reproduced in colors entirely different from colors of actual things to dissapoint users.

Factors greatly concerned with the color reproducibility are spectral sensitivity distribution and interlayer interimage effect (hereinafter simply referred to as interimage effect).

The following is known with regard to the interimage effect. That is, it is known in light-sensitive multi-layer color photographic materials to add a compound capable of forming a development restrainer or a precursor thereof as a result of its coupling with an oxidized product of a color developing agent, i.e., what is called DIR compound, and is known that the development restrainer released from this DIR compound inhibits the development of other color-forming layer to cause the interimage effect, thereby producing the effect of improving the color reproducibility.

In color negative films, use of colored couplers in an amount more than the amount necessary for compensating unwanted absorption makes it possible to give the same effect as the interimage effect.

Excessive use of the colored couplers, on the other hand, brings about an increase in minimum density, which makes it very difficult to make judgement on the correction of color and density when prints are obtained, often resulting in a poor quality of the colors of finished prints.

Incidentally, these techniques contribute an improvement in color reproducibility, in particular, in color purity. What is called diffusible DIR compounds, recently in wide use, whose development inhibitors or precursors released therefrom have a large mobility, greatly contribute the improvement in color purity. It, however, is difficult for the interimage effect to be controlled on its directionality. Hence, although the color purity can be made higher, the hues may undergo changes disadvantageously. The controlling of the directionality of interimage effect is disclosed in U.S. Pat. No. 4,725,529.

As for the spectral sensitivity distribution, U.S. Pat. No. 3,672,898 discloses spectral sensitivity distribution suitable for decreasing the variations of color reproducibility caused by differences in light sources used when photographs are taken.

This, however, can not be a means for improving the aforesaid colors giving a poor hue reproducibility.

In Japanese Patent Publication Open to Public Inspection (hereinafter referred to as Japanese Patent O.P.I. Publication) No. 34541/1986, which also discloses a technique in which the spectral sensitivity distribution and the interimage effect are combined, it is attempted in the aforesaid color films to improve the reproducibility on the colors the hue reproduction of which are difficult to achieve. This technique can be expected to bring about a certain effect. Its typical example is that the interimage effect is brought about not only from the respective blue-sensitive layer, green-sensitive layer and red-sensitive layer but also from a color-sensitive layer other than the above respective color-sensitive layers.

This technique is considered effective to a certain extent for improving the hue reproducibility of a particular color. In specific instances, however, it has the disadvantages that interimage effect-providing layers or silver halides of different types become necessary in addition to the original blue-sensitive, green-sensitive and red-sensitive layers in order for the interimage effect to be exhibited, and an increase in the silver weight or an increase in the number of steps for the manufacture results in a high production cost. Moreover, the effect thus obtainable can not be said to be satisfactory.

For the reasons stated above, the conventional light-sensitive silver halide color photographic materials have been unsatisfactory in the sense of the hue reproducibility. In particular, in respect of blue-green, it has been difficult to achieve a faithful hue reproducibility, tending to be reproduced in a hue far different from its actual color.

As for the color purity also, it is sought to be further improved. In particular, the color purity of reproductions of green subjects is sought to be improved.

SUMMARY OF THE INVENTION

A first object of the present invention is to provide a color photographic material that can faithfully reproduce hues, in particular, hues of blue-green or green subjects, in the reproduction of colors of subjects.

A second object of the present invention is to provide a color photographic material improved in color purity, in particular, color purity of reproductions of green subjects, in the reproduction of colors of subjects.

The light-sensitive color photographic material of the present invention comprises a support and provided thereon a blue-sensitive silver halide emulsion layer (hereinafter often "blue-sensitive layer") containing a yellow color forming coupler, a green-sensitive silver halide emulsion layer (hereinafter often "green-sensitive layer") containing a magenta color forming coupler and a red-sensitive silver halide emulsion layer (hereinafter often "red-sensitive layer" accordingly) containing a cyan color forming coupler, wherein;

the blue-sensitive silver halide emulsion layer has the maximum spectral sensitivity $S_{Bmax}$ at a wavelength $\lambda_{Bmax}$ within the range of from 415 nm to 470 nm, and a spectral sensitivity of the blue-sensitive emulsion layer at 480 nm, $S_{B480}$, is not more than 35% of the maximum sensitivity, $S_{Bmax}$, of the blue-sensitive emulsion layer; and the green-sensitive emulsion layer has the maximum spectral sensitivity $S_{Gmax}$ at a wavelength $\lambda_{Gmax}$ within the range of from 530 nm to 560 nm, and a spectral sensitivity of the green-sensitive emulsion layer at 500 nm $S_{G500}$ is not less than 25% of the maximum sensitivity, $S_{Gmax}$, of the green-sensitive emulsion layer.

The above spectral sensitivity is defined by a reciprocal of the amount of exposure necessary to form an image having a density higher than the minimum density by 0.7 (hereinafter "sensitivity at minimum density +0.7").

DETAILED DESCRIPTION OF THE INVENTION

In the present invention, the spectral sensitivity distribution is expressed as a function set up in the following way: A reciprocal of the amount of exposure that gives an image density of minimum density +0.7 at each wavelength measured when a light-sensitive material is exposed to spectral light of from 400 nm to 700 nm at intervals of several nm is regarded as the sensitivity at each wavelength, and this sensitivity is regarded as a function of the wavelength.

In the present invention, the spectral sensitivity distribution of the blue-sensitive layer and green-sensitive layer each can be made to accord with the constitution of the present invention by any suitable means arbitrarily used.

For example, such spectral sensitivity distribution can be obtained by using a spectral sensitizer.

In the light-sensitive material of the present invention, the spectral sensitivity distribution of the blue-sensitive silver halide emulsion layer is such that a wavelength giving a maximum sensitivity in spectral sensitivity distribution at a density of minimum density +0.7 of the blue-sensitive layer is in the range of from 415 to 470 nm and also a sensitivity at 480 nm in the spectral sensitivity distribution is not more than 35%, and preferably not more than 25%, of a sensitivity at the wavelength giving a maximum sensitivity in the spectral sensitivity distribution.

A means for giving the spectral sensitivity distribution of the blue-sensitive silver halide emulsion layer in the form according to the present invention may include, for one thing, a means wherein any silver halide is spectrally sensitized using a spectral sensitizer having a sensitizing spectrum in the intended wavelength region.

For another, it may include a means wherein, without use of any spectral sensitizer, the halogen composition or its distribution of a silver halide is brought into a proper condition so that the silver halide can have the intended spectral sensitivity, and also a means wherein a suitable optical absorber is used in a light-sensitive material so that it can be adjusted to the intended spectral sensitivity distribution.

As a matter of course, any of these means can also be used in combination.

Examples are shown below, of the spectral sensitizer used in the blue-sensitive silver halide emulsion layer of the light-sensitive material of the present invention for giving the spectral sensitivity distribution described above.

The spectral sensitizer(s) used in the blue-sensitive silver halide emulsion layer may preferably be in an amount of from $1\times10^{-6}$ to $5\times10^{-3}$ mol per mol of silver in total.

A-1

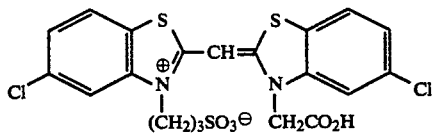

A-2

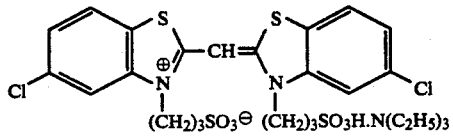

A-3

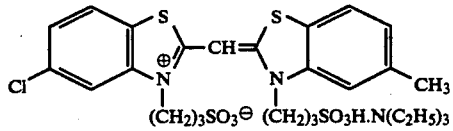

A-4

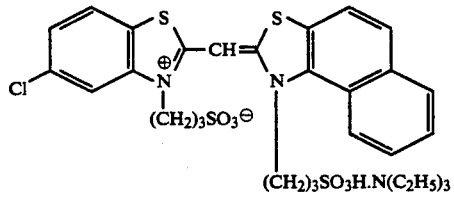

A-5

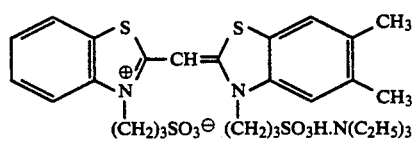

A-6

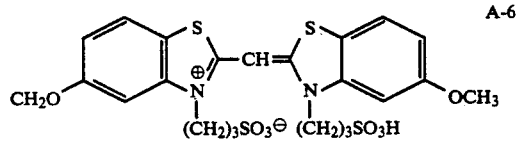

A-7

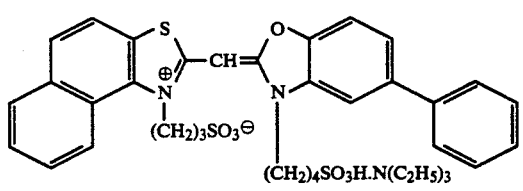

A-8

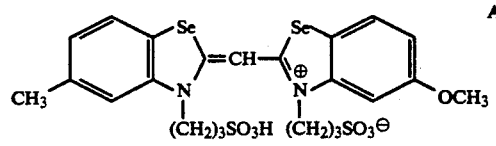

A-9

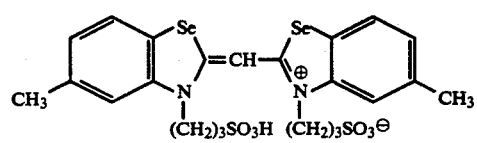

A-10

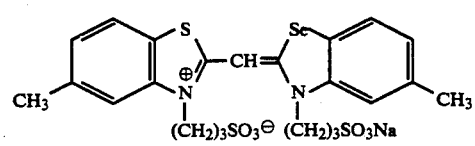

-continued

A-11

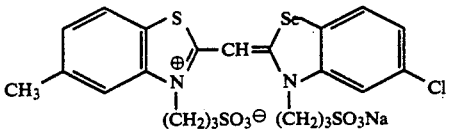

A-12

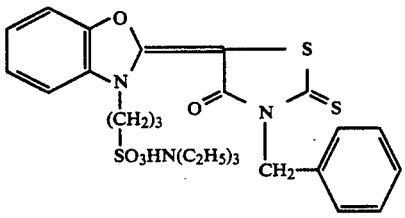

In the light-sensitive color photographic material of the present invention, the λGmax which is a wavelength giving a maximum sensitivity in spectral sensitivity distribution at a density of minimum density DGmin+0.7 of its blue-sensitive layer is:

$$530\ \text{nm} \leqq \lambda Gmax \leqq 560\ \text{nm},$$

and the $SG_{500}$ which represents a sensitivity at 500 nm is not more than 25% of the SGmax which represents a sensitivity at the λGmax.

The spectral sensitivity distribution of the green-sensitive layer can be readily made to fall in the region of the present invention, by using in the green-sensitive layer the following spectral sensitizers alone or in combination.

Examples of the spectral sensitizer usable in the green-sensitive layer are shown below. Examples are by no means limited to these.

OD-1

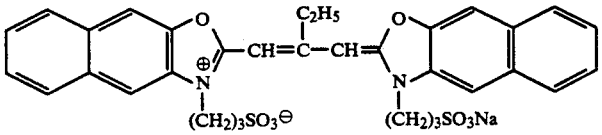

OD-2

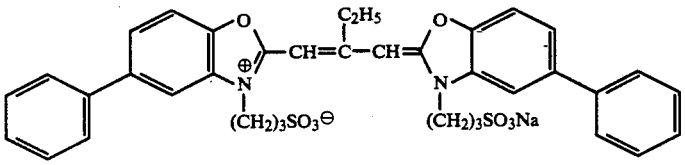

OD-3

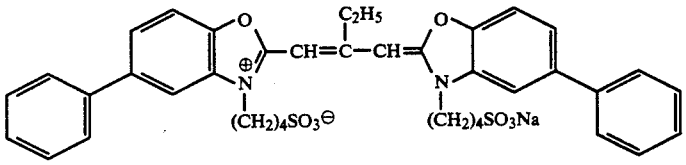

OD-4

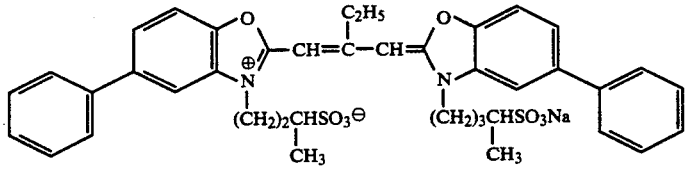

OD-5

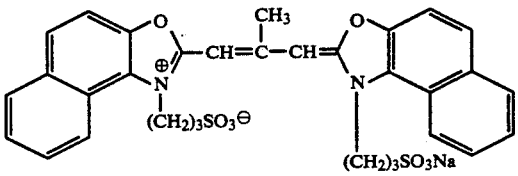

OD-6

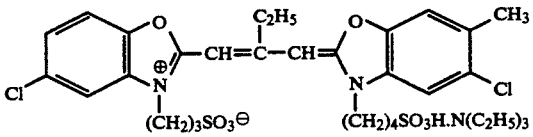

OD-7

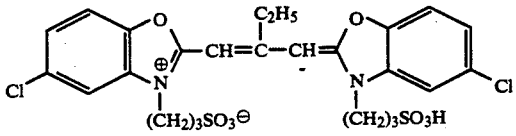

-continued
OD-8
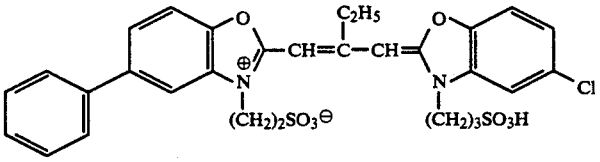
OD-9
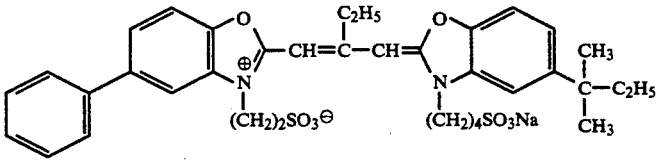
OD-10
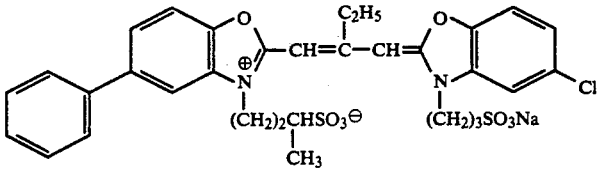
OD-11
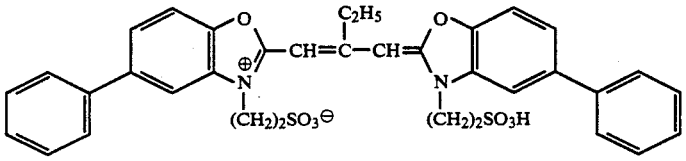
OD-12
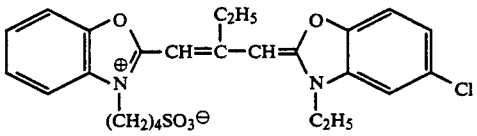
OD-13
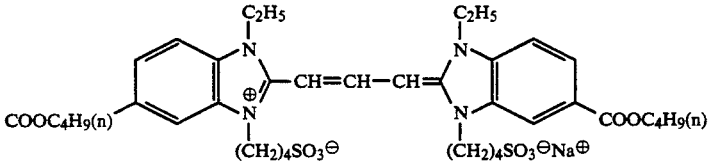
OD-14
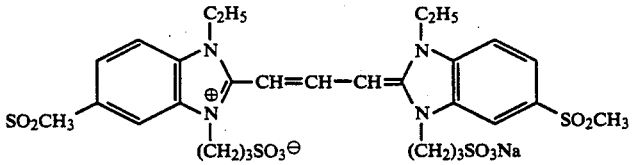
OD-15
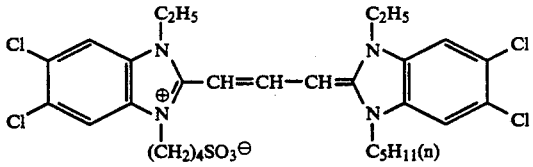
OD-16
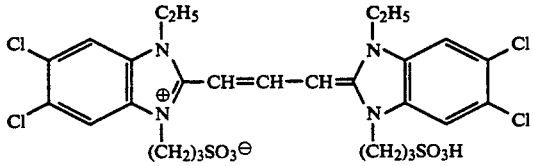

-continued

OD-17

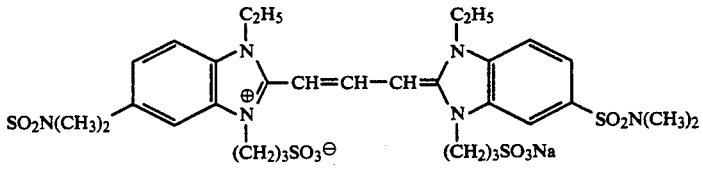

OD-18

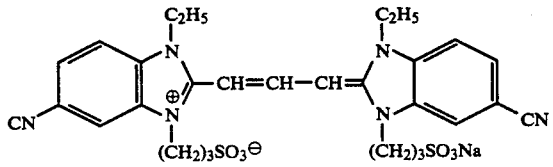

OD-19

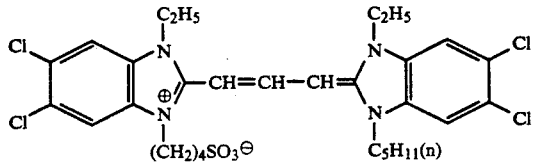

OD-20

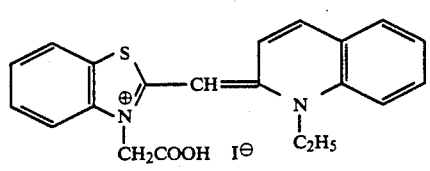

OD-21

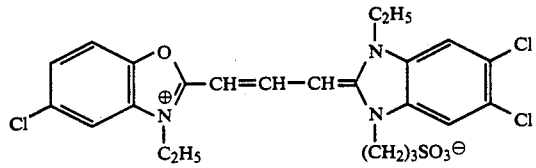

OD-22

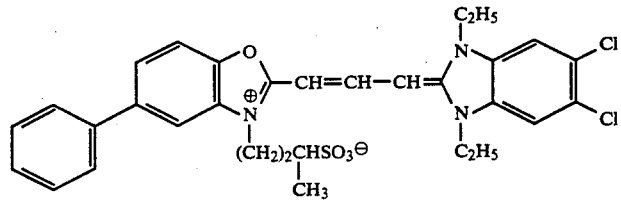

The spectral sensitizer(s) may be added in an amount optimal for giving the desired spectral sensitivity distribution. In general, the spectral sensitizer(s) used in the green-sensitive silver halide emulsion layer may preferably be in an amount of from $1\times10^{-5}$ to $5\times10^{-3}$ mol per mol of silver in total.

In the light-sensitive color photographic material of the present invention, a yellow filter layer can be used in order to attain the preferable spectral sensitivity of the green-sensitive layer. The yellow filter layer is preferably arranged at a portion farther from the support than the green-sensitive emulsion layer.

In the yellow filter layer, colloidal silver usually used can be used. In place of the colloidal silver, yellow-colored magenta couplers or yellow nondiffusion type organic dyes can also be used.

The yellow-colored magenta coupler that can be used can be arbitrarily selected from known compounds, without any particular limitations. Preferred examples thereof may include the following.

YF-1

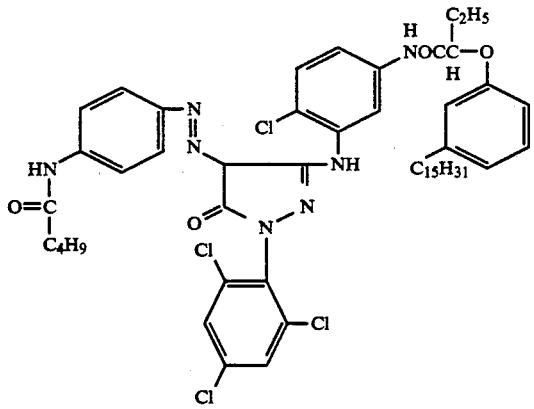

YF-2

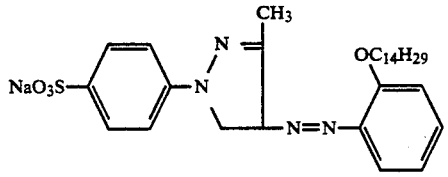

YF-3

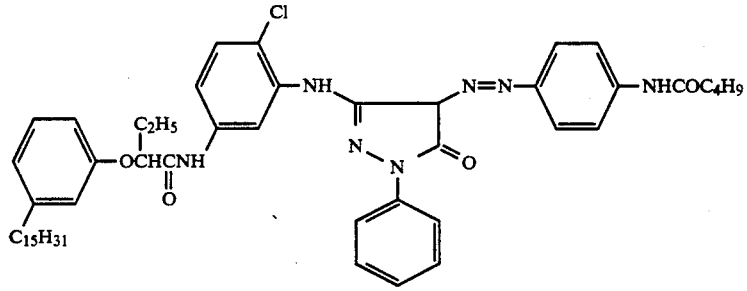

The yellow-colored magenta coupler can be introduced into the yellow filter layer by any known methods usually used for introducing couplers into silver halide emulsion layers.

For example, it is possible to use the method as disclosed in U.S. Pat. No. 2,322,027. It is also possible to use the polymer dispersion method as disclosed in Japanese Patent Examined Publication No. 39853/1976 or Japanese Patent O.P.I. Publication No. 59943/1976.

The yellow nondiffusion type organic dyes that can be used can be arbitrarily selected from known compounds, without any particular limitations. Preferred examples thereof may include the following.

YF-4

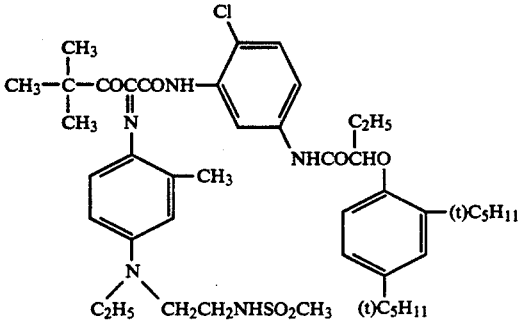

-continued

YF-5

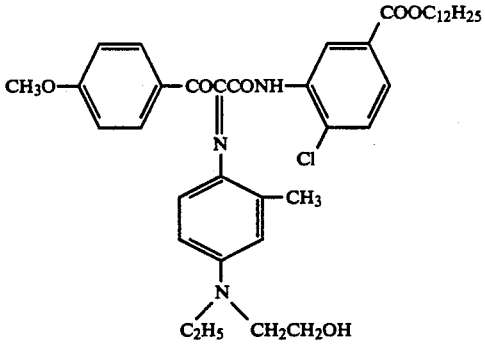

YF-6

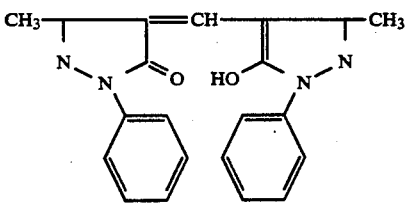

-continued

YF-7

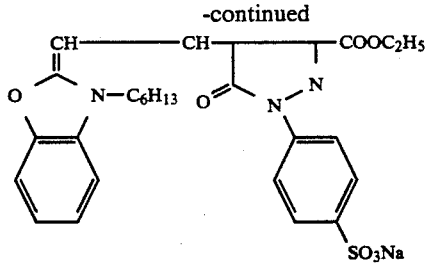

YF-8

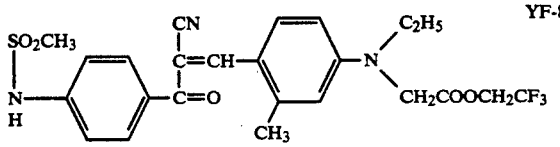

YF-9

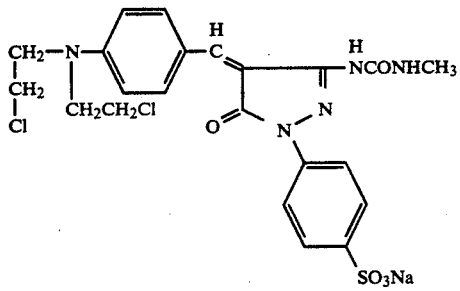

YF-10

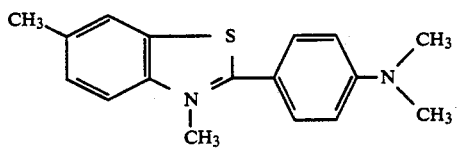

YF-11

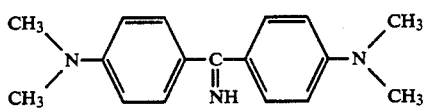

YF-12

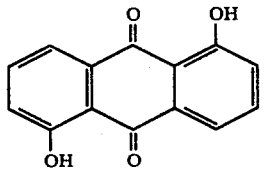

The yellow nondiffusion type organic dye described above can be introduced into the yellow filter layer by any known method. For example, in instances in which the organic dyes used are oil-soluble, it can be introduced by the same method as the yellow-colored magenta coupler previously described. In instances in which the organic dyes are water-soluble, it may be formed into an aqueous solution or an aqueous alkali solution and thus can be introduced into hydrophilic colloids.

In order to achieve the spectral sensitivity of the green-sensitive layer, preferable in the present invention, the colloidal silver particles, yellow-colored magenta coupler or organic dye can be added in an amount appropriately adjusted to an optimum.

In the present invention, various types of silver halide emulsion can be used. Among them, a monodisperse silver halide emulsion is preferable, which comprises silver halide grains having a breadth of grain size distribution not more than 20%. The breadth of grain size distribution is defined as follows:

$$\text{Breadth of grain size distribution (\%)} = \frac{\text{Standard deviation of grain size distribution}}{\text{Average grains size}} \times 100$$

The silver halide emulsions used in the light-sensitive color photographic material of the present invention can be chemically sensitized by conventional methods.

Antifoggants, stabilizers, etc. can be added to the silver halide emulsions. As binders for the emulsions, it is advantageous to use gelatin, without limitation thereto.

The emulsion layers and other hydrophilic colloid layers can be hardened. Plasticizers, dispersants of water-soluble or sparingly water-soluble polymers, etc. can also be contained therein.

The present invention can be preferably used in color negative films or color reversal films.

Couplers commonly used for color formation are used in the emulsion layers of the light-sensitive color photographic material of the present invention.

It is also possible to use colored couplers having the effect of correction, competing couplers, and chemical substances capable of releasing photographically useful fragments such as a development inhibitor, a development accelerator, a bleaching accelerator, a developer, a silver halide solvent, a color controlling agent, a hardening agent, a fogging agent, an antifoggant, a chemical sensitizer, a spectral sensitizer and a desensitizer upon coupling with an oxidized product of a developing agent. In the light-sensitive material, a diffusible DIR compound such described as in U.S. Pat. No. 4,725,529 is preferably used, which is capable of releasing a development inhibitor or its precursor having a diffusibility not less than 0.34, and more preferably not less than 0.40, upon reaction with an oxidation product of a developing agent. The DIR compound may be contained in at least one silver halide emulsion layer.

The light-sensitive material can be provided with auxiliary layers such as a filter layer, an anti-halation layer and an anti-irradiation layer. These layers and/or emulsion layers may be incorporated with dyes capable of flowing out of the light-sensitive material or being bleached during photographic processing.

Formalin scavengers, fluorescent brightening agents, matting agents, lubricants, image stabilizers, surface active agents, anti-color-foggants, development accelerators and bleaching accelerators can be added to the light-sensitive material.

As the support, it is possible to use any supports such as paper laminated with polyethylene or the like, polyethylene terephthalate film, baryta paper and cellulose triacetate film.

In order to obtain dye images using the light-sensitive color photographic material of the present invention, the light-sensitive material may be exposed to light followed by conventionally known color photographic processing.

EXAMPLES

Example 1

On a triacetyl cellulose film support, layers each having the composition as shown below were formed in order of the stated layers to prepare a multi-layer light-sensitive color photographic material, sample 101. Samples 102 to 105 were also prepared as described later.

In all the following examples, the amount of each compound added in the light-sensitive silver halide photographic material is indicated as gram number per 1 $m^2$ unless particularly noted. The amounts of silver halide and colloidal silver are in terms of silver weight. Those of spectral sensitizers are each indicated as molar number per mol of silver halide in the same layer.

Sample 101 (Comparative Example)

| | |
|---|---|
| First layer: Anti-halation layer (HC-1) | |
| Black colloidal silver | 0.20 |
| UV absorbent (UV-1) | 0.20 |
| High-boiling solvent (Oil-1) | 0.20 |
| Gelatin | 1.5 |
| Second layer: Intermediate layer (IL-1) | |
| UV absorbent (UV-1) | 0.04 |
| High-boiling solvent (Oil-1) | 0.04 |
| Gelatin | 1.2 |
| Third layer: Low-speed red-sensitive emulsion layer (RL) | |
| Silver iodobromide emulsion (Em-1) | 0.6 |
| Spectral sensitizer (SD-1) | $3.0 \times 10^{-4}$ (mol/mol · Ag) |
| Spectral sensitizer (SD-2) | $1.5 \times 10^{-4}$ (mol/mol · Ag) |
| Spectral sensitizer (SD-3) | $3.0 \times 10^{-4}$ (mol/mol · Ag) |
| Cyan coupler (C-1) | 0.65 |
| Colored cyan coupler (CC-1) | 0.12 |
| DIR compound (D-1) | 0.004 |
| DIR compound (D-2) | 0.04 |
| High-boiling solvent (Oil-1) | 0.6 |
| Gelatin | 1.5 |
| Fourth layer: High-speed red-sensitive emulsion layer (RH) | |
| Silver iodobromide emulsion (Em-2) | 0.8 |
| Spectral sensitizer (SD-1) | $1.8 \times 10^{-4}$ (mol/mol · Ag) |
| Spectral sensitizer (SD-2) | $1.0 \times 10^{-4}$ (mol/mol · Ag) |
| Spectral sensitizer (SD-3) | $1.8 \times 10^{-4}$ (mol/mol · Ag) |
| Cyan coupler (C-2) | 0.13 |
| Cyan coupler (C-3) | 0.02 |
| Colored cyan coupler (CC-1) | 0.03 |
| DIR compound (D-2) | 0.02 |
| High-boiling solvent (Oil-1) | 0.2 |
| Gelatin | 1.3 |
| Fifth layer: Intermediate layer (IL-2) | |
| Gelatin | 0.7 |
| Sixth layer: Low-speed green-sensitive emulsion layer (GL) | |
| Silver iodobromide emulsion (Em-1) | 0.8 |
| Spectral sensitizer (OD-1) | $3.0 \times 10^{-4}$ (mol/mol · Ag) |
| Spectral sensitizer (OD-2) | $5.0 \times 10^{-4}$ (mol/mol · Ag) |
| Magenta coupler (M-1) | 0.5 |
| Magenta coupler (M-2) | 0.05 |
| Colored magenta coupler (CM-1) | 0.1 |
| DIR compound (D-3) | 0.02 |
| DIR compound (D-4) | 0.005 |
| High-boiling solvent (Oil-2) | 0.4 |
| Gelatin | 1.0 |
| Seventh layer: High-speed green-sensitive emulsion layer (GH) | |
| Silver iodobromide emulsion (Em-2) | 0.9 |
| Spectral sensitizer (OD-1) | $1.5 \times 10^{-4}$ (mol/mol · Ag) |
| Spectral sensitizer (OD-2) | $2.5 \times 10^{-4}$ (mol/mol · Ag) |
| Magenta coupler (M-2) | 0.09 |
| Colored magenta coupler (CM-2) | 0.03 |
| DIR compound (D-3) | 0.05 |
| High-boiling solvent (Oil-2) | 0.3 |
| Gelatin | 1.0 |

-continued

| | |
|---|---|
| Eighth layer: Yellow filter layer (YC) | |
| Yellow colloidal silver | 0.1 |
| Anti-color-contamination agent (SC-1) | 0.1 |
| High-boiling solvent (Oil-3) | 0.1 |
| Gelatin | 0.8 |
| Ninth layer: Low-speed blue-sensitive emulsion layer (BL) | |
| Silver iodobromide emulsion (Em-1) | 0.5 |
| Spectral sensitizer (SD-5) | $0.6 \times 10^{-3}$ (mol/mol · Ag) |
| Yellow coupler (Y-1) | 0.5 |
| Yellow coupler (Y-2) | 0.2 |
| DIR compound (D-2) | 0.02 |
| High-boiling solvent (Oil-3) | 0.3 |
| Gelatin | 1.0 |
| Tenth layer: High-speed blue-sensitive emulsion layer (BH) | |
| Silver iodobromide emulsion (Em-3) | 0.55 |
| Spectral sensitizer (SD-5) | $0.35 \times 10^{-3}$ (mol/mol · Ag) |
| Yellow coupler (Y-1) | 0.20 |
| High-boiling solvent (OiI-2) | 0.07 |
| Gelatin | 0.8 |
| Eleventh layer: First protective layer (PRO-1) | |
| Fine-grain silver iodobromide emulsion (average grain size: 0.08 μm; AgI: 2 mol %) | 0.4 |
| UV absorbent (UV-1) | 0.10 |
| UV absorbent (UV-2) | 0.05 |
| High-boiling solvent (Oil-1) | 0.1 |
| High-boiling solvent (Oil-4) | 0.1 |
| Formalin scavenger (HS-1) | 0.5 |
| Formalin scavenger (HS-2) | 0.2 |
| Gelatin | 1.0 |
| Twelfth layer: Second protective layer (PRO-2) | |
| Alkali-soluble matting agent (average particle diameter: 2 μm) | 0.15 |
| Polymethyl methacrylate (average particle diameter: 3 μm) | 0.05 |
| Gelatin | 0.5 |

Coating aids Su-1 and Su-2, dispersion aids Su-3 and Su-4, hardening agents H-1 and H-2, lubricant AX-1, stabilizer ST-1, and antifoggants AF-1 and two kinds of AF-2 with Mw of 10,000 and Mw of 1,100,000 were also incorporated in addition to the above composition.

Emulsions used in the above sample were as follows:

Em-1:
- Average grain size: 0.27μm
- Average silver iodide content: 7.0 mol %
- Monodisperse (breadth of grain size distribution: 18%), core/shell silver iodobromide emulsion having a shell with a silver iodide content of 1 mol %

Em-2:
- Average grain size: 0.38 μm
- Average silver iodide content: 7.0 mol %
- Monodisperse (breadth of grain size distribution: 18%), core/shell silver iodobromide emulsion having a shell with a silver iodide content of 0.5 mol %

Em-3:
- Average grain size: 0.45 μm
- Average silver iodide content: 8.0 mol %
- Monodisperse (breadth of grain size distribution: 16%), core/shell silver iodobromide emulsion having a shell with a silver iodide content of 1.0 mol %

Em-4:
- Average grain size: 0.27 μm
- Average silver iodide content: 3.0 mol %
- Monodisperse (breath of grain size distribution: 17%), core/shell silver iodobromide emulsion having a shell with a silver iodide content of 1.0 mol %

Em-5:

Average grain size: 0.45 μm
Average silver iodine content: 3.0 mol %
Monodisperse (breadth of grain size distribution: 16%), core/shell silver iodobromide emulsion having a shell with a silver iodide content of 1.0 mol %
Compounds used in the above sample are as follows:
SD-1
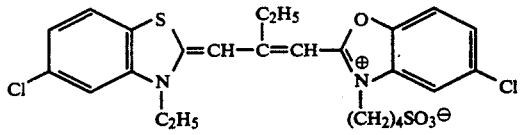
SD-2
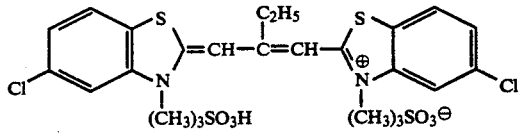
SD-3
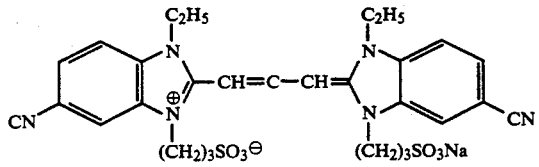
SD-4
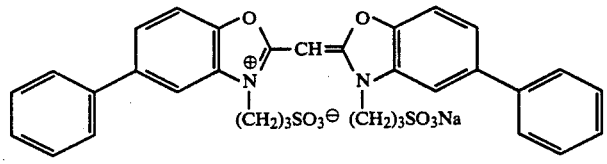
SD-5
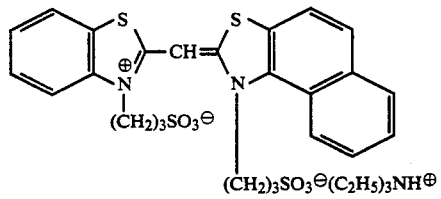
C-1
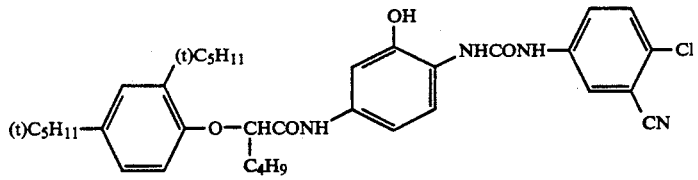
C-2
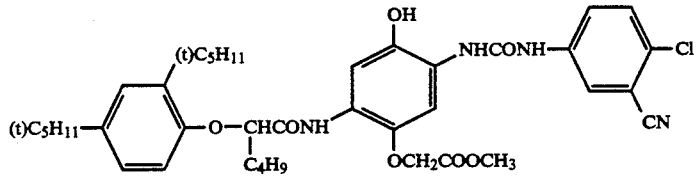
C-3
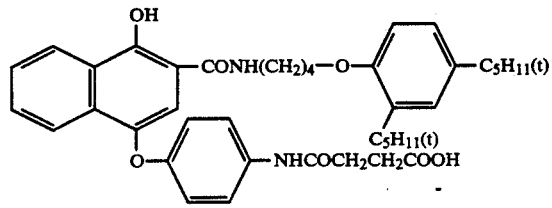

-continued
M-1
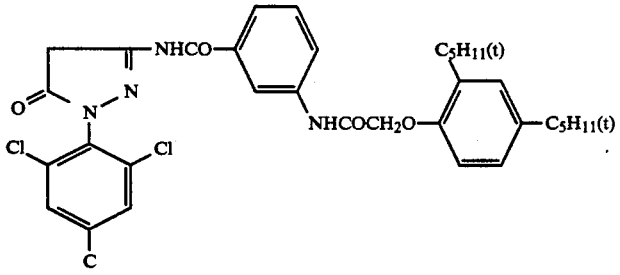
M-2
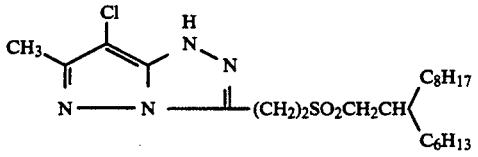
Y-1
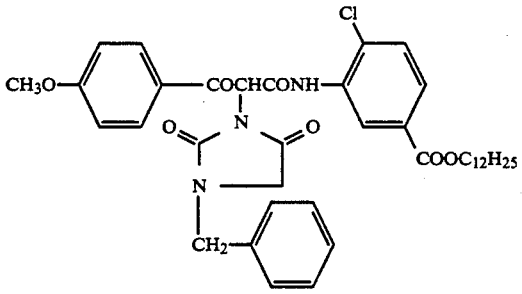
Y-2
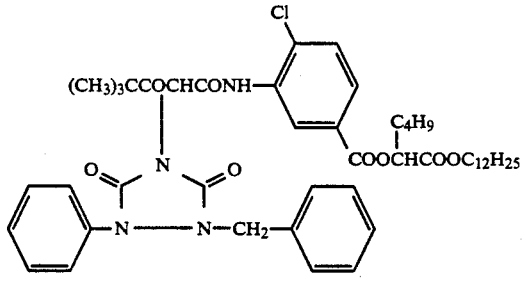
CC-1
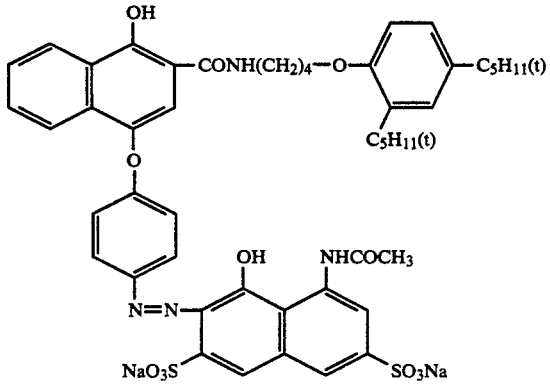

-continued
CM-1
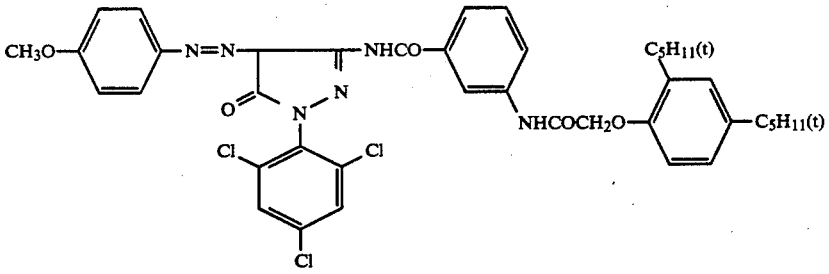
CM-2
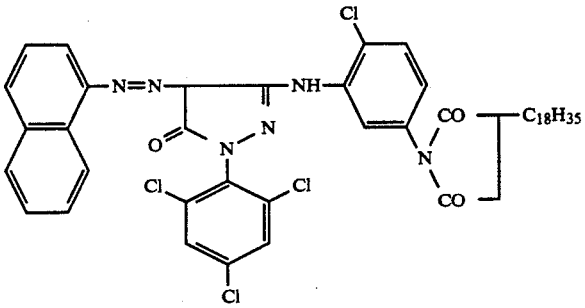
D-1
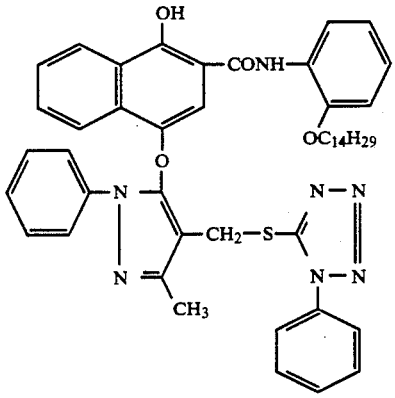
D-2
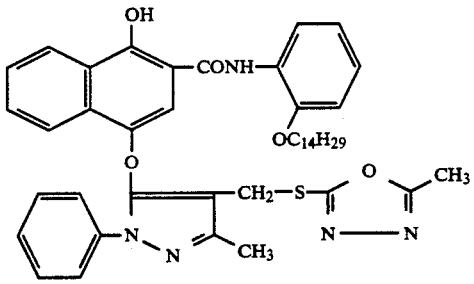
D-3
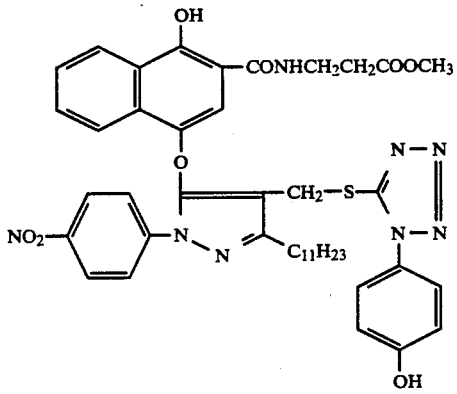

-continued
D-4
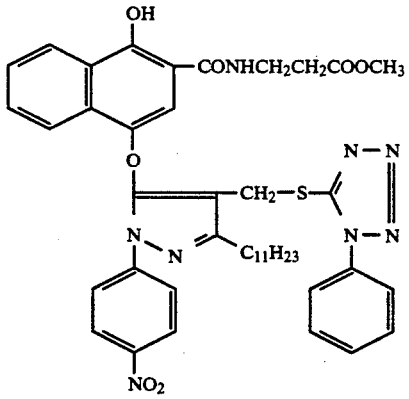
UV-1
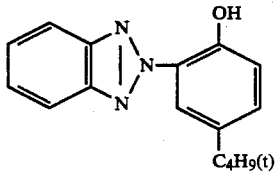
UV-2
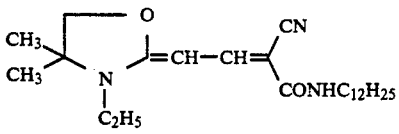
HS-1
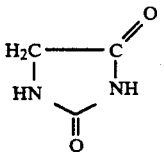
HS-2
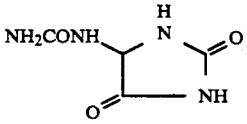
H-1
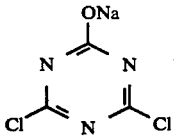
$(CH_2{=}CHSO_2CH_2)_2O$ H-2
$NaO_3S{-}CHCOOCH_2(CF_2CF_2)_3H$
$CH_2COOCH_2(CF_2CF_2)_3H$ Su-1
$NaO_3S{-}CHCOOC_8H_{17}$
$CH_2COOC_8H_{17}$ Su-2
Su-3
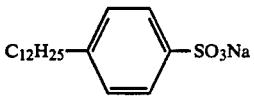

-continued
Su-3
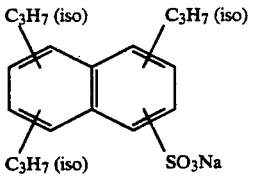
SC-1
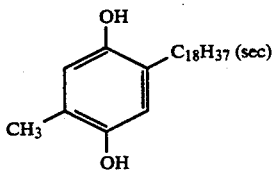
WAX-1
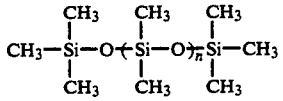
Mw = 3,000
Oil-1
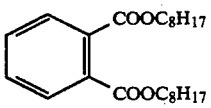
Oil-2
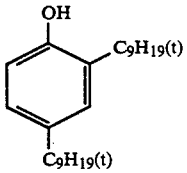
Oil-3
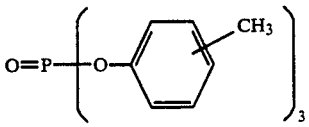
Oil-4
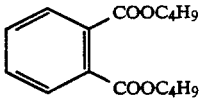
ST-1
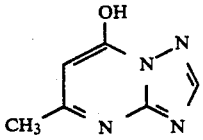
AF-1
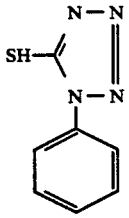
AF-2
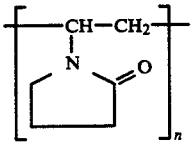
n: degree of polymeriaztion Sample 102 (Comparative Example)

The procedure for sample 101 was repeated to give sample 102, except that the spectral sensitizer SD-5 used in the ninth and tenth layers each was replaced with A-7.

Sample 103 (Comparative Example)

The procedure for sample 101 was repeated to give sample 103, except that;

(1) the spectral sensitizers used in the sixth layer were replaced with the following:

| | |
|---|---|
| Spectral sensitizer (OD-1) | $1.0 \times 10^{-4}$ (mol/mol · Ag) |
| Spectral sensitizer (OD-2) | $5.0 \times 10^{-4}$ (mol/mol · Ag) |
| Spectral sensitizer (OD-20) | $2.0 \times 10^{-4}$ (mol/mol · Ag) |
| and; | |

(2) the spectral sensitizers used in the seventh layer were replaced with the following:

| | |
|---|---|
| Spectral sensitizer (OD-1) | $0.5 \times 10^{-4}$ (mol/mol · Ag) |
| Spectral sensitizer (OD-2) | $2.5 \times 10^{-4}$ (mol/mol · Ag) |
| Spectral sensitizer (OD-20) | $1.0 \times 10^{-4}$ (mol/mol · Ag) |

Sample 104 (Present Invention)

The procedure for sample 103 was repeated to give sample 104, except that the spectral sensitizer SD-5 used in the ninth and tenth layers each was replaced with A-7.

Sample 105 (Present Invention)

The procedure for sample 104 was repeated to give sample 105, except that the Em-1 in the ninth layer and the Em-3 in the tenth layer were replaced with Em-4 and Em-5, respectively.

Using the samples 101 to 105 thus prepared, a color rendition chart available from Macbeth Co. and a cloth with blue-green color were simultaneously photographed on the same sample. Thereafter the following photographic processing was carried out.

Processing steps (38° C.):

| | |
|---|---|
| Color developing | 3 minutes 15 seconds |
| Bleaching | 6 minutes 30 seconds |
| Washing | 3 minutes 15 seconds |
| Fixing | 6 minutes 30 seconds |
| Washing | 3 minutes 15 seconds |
| Stabilizing | 1 minute 30 seconds |
| Drying | |

Processing solutions used in the respective processing steps had the following composition.

Color Developing Solution

| | |
|---|---|
| 4-Amino-3-methyl-N-ethyl-N-(β-hydroxyethyl) aniline.sulfate | 4.75 g |
| Anhydrous sodium sulfite | 4.25 g |
| Hydroxyamine.½ sulfate | 2.0 g |
| Anhydrous potassium carbonate | 37.5 |
| Sodium bromide | 1.3 g |
| Trisodium nitrilotriacetatate (monohydrate) | 2.5 g |
| Potassium hydroxide | 1.0 g |

Made up to 1 liter by adding water (pH: 10.1).

Bleaching Solution

| | |
|---|---|
| Ferric ammonium ethylenediaminetetraacetate | 100 g |
| Diammonium ethylenediaminetetraacetate | 10.0 g |
| Ammonium bromide | 150.0 g |
| Glacial acetic acid | 10 ml |

Made up to 1 liter by adding water, and adjusted to pH 6.0 using ammonium water.

Fixing Solution

| | |
|---|---|
| Ammonium thiosulfate | 175.0 g |
| Anhydrous sodium sulfite | 8.5 g |
| Sodium metasulfite | 2.3 g |

Made up to 1 liter by adding water, and adjusted to pH 6.0 using acetic acid.

Stabilizing Solution

| | |
|---|---|
| Formalin (aqueous 37% solution) | 1.5 ml |
| Konidax (available from Konica Corporation) | 7.5 ml |

Made up to 1 liter by adding water.

Spectral sensitivity at minimum density +0.7 of each sample was measured to determine the values of λBmax, $(SB_{480}/SBmax)\times 100$, λGmax, and $(SG_{500}/SGmax)\times 100$. The values obtained are shown in Table 1.

Through the films obtained, images were printed on color paper (Konica Color PC Paper, Type SR; available from Konica Corporation) so as for the gray colors with optical density 0.7 to have the same density. Color images were thus obtained. On the color reproductions of the images, the reproductions of the cloth with blue-green color (BG) and of the Macbeth color chart with green color (G) were compared with the original chart and cloth to judge their hues and color purities. Results obtained are shown together in Table 2. As shown in Table 2, the samples according to the present invention are improved in the hue reproducibility of blue-green and green and improved in the color purity of green, and thus they are seen to have good color color reproducibility.

TABLE 1

| Sample No. | λBmax (nm) | $(SB_{480}/SBmax) \times 100$ | λGmax (nm) | $(SG_{500}/SGmax) \times 100$ |
|---|---|---|---|---|
| 101(X) | 475 | 80 | 555 | 17 |
| 102(X) | 450 | 30 | 555 | 17 |
| 103(X) | 475 | 80 | 546 | 33 |
| 104(Y) | 450 | 30 | 546 | 33 |
| 105(Y) | 440 | 20 | 546 | 33 |

X: Comparative Example
Y: Present Invention

TABLE 2

| | Color reproducibility | | |
|---|---|---|---|
| Sample No. | Hue of blue-green cloth (BG) | Hue of green (G) of Macbeth chart | Color purity of green (G) of Macbeth chart |
| 101(X) | Blue | Blue-green | Dark, turbid |
| 102(X) | Slightly bluish blue-green | Green | Dark, turbid |
| 103(X) | Deeply bluish blue-green | Blue-green | Bright |

TABLE 2-continued

| Sample No. | Color reproducibility | | |
|---|---|---|---|
| | Hue of blue-green cloth (BG) | Hue of green (G) of Macbeth chart | Color purity of green (G) of Macbeth chart |
| 104(Y) | Blue-green | Green | Bright |
| 105(Y) | Blue-green | Green | Bright |

X: Comparative Example
Y: Present Invention

What is claimed is:

1. A silver halide color photographic light-sensitive material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein said blue-sensitive emulsion layer has the maximum spectral sensitivity $S_{Bmax}$ at a wavelength $\lambda_{Bmax}$ within the range of from 415 nm to 470 nm, and a spectral sensitivity of said blue-sensitive emulsion layer at 480 nm, $S_{B480}$, is not more than 35% of said maximum sensitivity $S_{Bmax}$ of said blue-sensitive emulsion; and said green-sensitive emulsion layer has the maximum spectral sensitivity $S_{Gmax}$ at a wavelength $\lambda_{Gmax}$ within the range of from 530 nm to 560 nm, and a spectral sensitivity of said green-sensitive emulsion layer at 500 nm, $S_{G500}$, is not less than 25% of said maximum sensitivity $S_{Gmax}$ of said green-sensitive emulsion layer, wherein said sensitivity is defined by a reciprocal of the amount of exposure necessary to form an image having a density higher than the minimum density of each emulsion layer by 0.7.

2. The light-sensitive material of claim 1, wherein at least one of said silver halice emulsion layers contains a diffusible DIR compound capable of releasing a development inhibitor or precursor thereof each having a diffusibility of not less than 0.34.

3. The light-sensitive material of claim 1, wherein at least one of said silver halide emulsion layers comprises silver halide grains having a breadth of grain distribution not more than 20%.

* * * * *